United States Patent [19]

Payne

[11] 4,096,938

[45] Jun. 27, 1978

[54] APPARATUS FOR TRANSFERRING CIGARETTES ON A CIGARETTE PACKAGING MACHINE

[75] Inventor: Leslie Elmer Payne, Winston-Salem, N.C.

[73] Assignee: R. J. Reynolds Tobacco Company, Winston-Salem, N.C.

[21] Appl. No.: 648,605

[22] Filed: Jan. 8, 1976

Related U.S. Application Data

[63] Continuation of Ser. No. 498,823, Aug. 19, 1974, abandoned.

[51] Int. Cl.[2] ..... B65G 65/44

[52] U.S. Cl. ..... 198/420; 53/151; 198/540; 198/616; 214/6 M

[58] Field of Search ..... 198/20 C, 24, 53 R, 198/59, 540, 550, 616, 429, 420; 53/148–151; 131/25; 214/6 M, 6.5

[56] References Cited

U.S. PATENT DOCUMENTS

| | | | |
|---|---|---|---|
| 1,539,745 | 5/1925 | Kerlin et al. | 53/149 |
| 1,765,820 | 6/1930 | Bronander et al. | 53/151 |
| 2,334,142 | 11/1943 | Arelt | 53/149 |
| 3,106,282 | 10/1963 | Schmermund | 198/24 |
| 3,403,493 | 10/1968 | Focke | 53/151 |
| 3,435,940 | 4/1969 | Seragnoli | 198/24 |
| 3,531,911 | 10/1970 | Gianese | 53/151 |
| 3,735,767 | 5/1973 | Kruse et al. | 53/148 |
| 3,869,035 | 3/1975 | Focke | 198/24 |

*Primary Examiner*—Evon C. Blunk
*Assistant Examiner*—Jeffrey V. Nase
*Attorney, Agent, or Firm*—Grover M. Myers

[57] ABSTRACT

A supply and transfer mechanism for use on a cigarette packaging machine including a hopper for receiving a supply of cigarettes, said hopper having a reservoir portion and a vein section. The vein section channels the cigarettes from the reservoir portion into at least three counter sections. A plunger is provided to transfer the cigarettes in the three counter sections into three compression pockets carried on a rotary drum which indexes adjacent to the counter section.

9 Claims, 4 Drawing Figures

APPARATUS FOR TRANSFERRING CIGARETTES ON A CIGARETTE PACKAGING MACHINE

This is a continuation of application Ser. No. 498,823, filed Aug. 19, 1974, now abanded.

BACKGROUND OF THE INVENTION

This invention relates to an improved supply and transfer mechanism for a cigarette packaging machine having a plurality of rotary compression pockets to receive the cigarettes transferred from a counter section.

Many cigarette manufacturing companies have for a number of years used the AMF (American Machine and Foundry) packer as the workhouse of their packing lines. This machine transfers a single group of twenthy cigarettes from a counter section into a single compression pocket carried on a rotary turret. These AMF packers normally have a hopper or cigarette bin which receives the cigarettes from the cigarette maker. Cigarettes are passed through a plurality of veins, normally three on each side, downwardly to the counter section. The veins through which these cigarettes pass have agitators at their upper end which agitate the cigarettes and keep them moving. The width of each vein will permit only one cigarette at a time to pass therethrough, and each vein generally begins vertically and tends to flatten out or become horizontal at the counter section. The agitators and weight of the cigarettes in the upper end of the veins forces the cigarettes in the lower end of the veins into the counter section. In the normal AMF packer, the horizontal counter section has three levels. The first level has seven cigarettes, the second level has six cigarettes and the third level has seven cigarettes, making a total of twenty cigarettes in the counter section at any one time. When twenty cigarettes have entered the counter section a plunger is operated to transfer the cigarettes from the counter section through a mouthpiece into a compression pocket carried on the rotary turret. The compression pocket compresses the twenty cigarettes into a desired size as it rotates on the turret to a wrapping station.

This AMF was originally designed to operate at a rate of approximately 125 packs of cigarettes per minute. Since the packs-per-minute rate indicates the efficiency of a manufacturing plant, most of the companies have tried to improve or increase the packing rate of the AMF packer. Various changes have been made to this packer which have increased its rate of production to about 175 packs per minute or better.

It has been found, however, that, by increasing the packing rate, problems have been encountered in the quality of the product produced. As the packer rate increases, the amount of tobacco which is jarred loose from the cigarettes is increased. This is due primarily to the rougher overall handling of the cigarettes and, in particular, to the impact of the plunger on the cigarettes as they are transferred from the counter section to the compression packet. These loosely-packed cigarettes which result from this rough handling are termed "loose end" cigarettes and are not desirable as a finished product.

Another problem which has been noted by increasing the speed of the packers is the rebound problem which produces cut-off cigarettes. As the speed of the packer is increased, the plunger assembly moves more quickly into the counter section, inserts a group of cigarettes into the compression pocket and then returns to the ready position so that there will be enough time for the cigarettes in the veins to migrate into the counter section while the compression pocket turret is indexing at the next pocket. Because the cigarettes are transferred from a counter section to the compression pocket with greater force due primarily to the increased speed of the plunger and the plunger is retracted at a greater speed, there is an increased tendency for the cigarettes to rebound from the pocket as they strike the back stop positioned behind the pocket. This rebounding of the cigarettes causes their ends to extend beyond the end of the pocket so that they are cut off as the compression pocket turret is rotated to the packaging position.

Still other problems appear with the increased speed of the packer; for example, it has been found that more wrinkled or buckled cigarettes are found in the finished packs where the speed of the packer was maintained at a relatively high rate. It has also been found that light packs (packages with less than twenty cigarettes) are more prominent when the speed of the packer is increased. This, of course, is primarily because there is insufficient time for the cigarettes in the veins to be fed to the counter section.

Thus, the primary reason for not being able to increase the speed of the AMF packer is the time required for the cigarettes to move from the vein into the counter section.

Some effects have been made to reduce this time by directing two extra veins from the hopper from a more vertical position so that the cigarettes are fed into the single counter section quicker. Although this approach has decreased the number of light packs at higher speeds, it has not appreciably reduced "loose end" cigarettes, the wrinkling problem or the rebound cut-off problem.

Another reason for increasing the speed of the packers now utilized is because of the new generation of cigarette maker machines which are now being developed. The cigarette makers are expected to increase the production of cigarettes to approximately 250 packs per minute. Normally, the industry likes to have one cigarette maker providing the input for one packing machine. It can be easily seen that, at the rate of the presently used packers, it would be impossible to put the new cigarette makers and the cigarette packers on a one-to-one basis. The alternatives which the industry would have would appear to be to reduce the speed of the new cigarette makers to make them compatible with the packers, add additional packers to take care of the excess produced by the new makers, buy new packers which can keep up with the new makers or increase the speed of the presently used packers. Since the purpose of buying the new cigarette makers is to increase production, decreases in the speed of the maker would be counter-productive. If more of the presently used makers were bought, it might permit the new cigarette makers to be run at top speed, but it would do nothing for the quality control problems mentioned above. As can be easily understood, if new packers were purchased to keep up with the new makers, the investment would be enormous. Therefore, it would be a great advantage to increase the pack/minute rate of the presently used packers to permit them to be hooked up in a direct one-to-one relationship with the new generation of makers. The present invention accomplishes this result as well as eliminating the quality control problems of loose end cigarettes, light packs, wrinkled or buckled cigarettes and the rebound problem.

SUMMARY OF THE INVENTION

It is, therefore, an object of this invention to provide an improved supply and transfer mechanism for use on cigarette packaging machines having a plurality of rotating compression pockets.

Another object of the invention is to provide a mechanism for use on a cigarette packaging machine which will significantly reduce light packs when operating at high packaging rates.

Another object of this invention is to provide a device for use on a cigarette packer in which the handling of the cigarettes throughout the device is more gentle than on the presently used packers, thereby reducing loose ends of cigarettes being packed.

Another object of this invention is to provide a device for use on a cigarette packer wherein the plunger speed is reduced so that the impact against the cigarettes is also greatly reduced.

Another object of this invention is to provide a supply and transfer device for a cigarette packaging machine which will not deform or crimp the cigarettes as they are being transferred from the counter section to a compression pocket.

Another object of the invention is to provide more dwell time for filling the counter section of a cigarette packer prior to the plunger being inserted in the counter section.

Still another object of the invention is to provide a transfer mechanism which will reduce the rebound of the cigarettes when they are inserted in the compression pocket and, thus, reduce the number of cut-off cigarettes.

These and other objects are accomplished by the present invention through the use of a new supply and transfer mechanism including a hopper for receiving a supply of cigarettes, a vein section having at least three counter sections, a plunger assembly having at least three plungers to insert into the counter sections and a drive means to manipulate the plunger assembly. The vein section includes three feed paths, each including three feed veins which are fed from the hopper. Each of the three feed paths terminates in a counter section divided into three compartments, each compartment being fed by a single feed vein. Each counter section receives twenty cigarettes to be delivered to the compression pockets on the compression pocket turret. The counter sections are located in front of the turret and are so positioned that they correspond to the top three compression pocket positions when the turret is indexed. The veins leading to the center counter section are generally perpendicular while the veins to the two outside counter sections are positioned on a slight angle from the perpendicular. A plurality of driven agitators are located within the feed hopper at the upper ends of each of the feed veins. There are two agitators associated with each feed vein.

A three-prong plunger assembly is positioned in front of the counter section and will reciprocate to engage the cigarettes in each of the counter sections and force them into the top three compression pockets positioned behind the counter sections. The drive mechanism means is provided to reciprocate the plunger assembly as well as control the time cycle for insertion.

BRIEF DESCRIPTION OF THE DRAWINGS

The foregoing and additional objects, features and advantages of the invention will be apparent to those skilled in the art from the following detailed description of a preferred embodiment thereof, taken with the accompanying drawings, in which.

DESCRIPTION OF A PREFERRED EMBODIMENT

Figure 1:
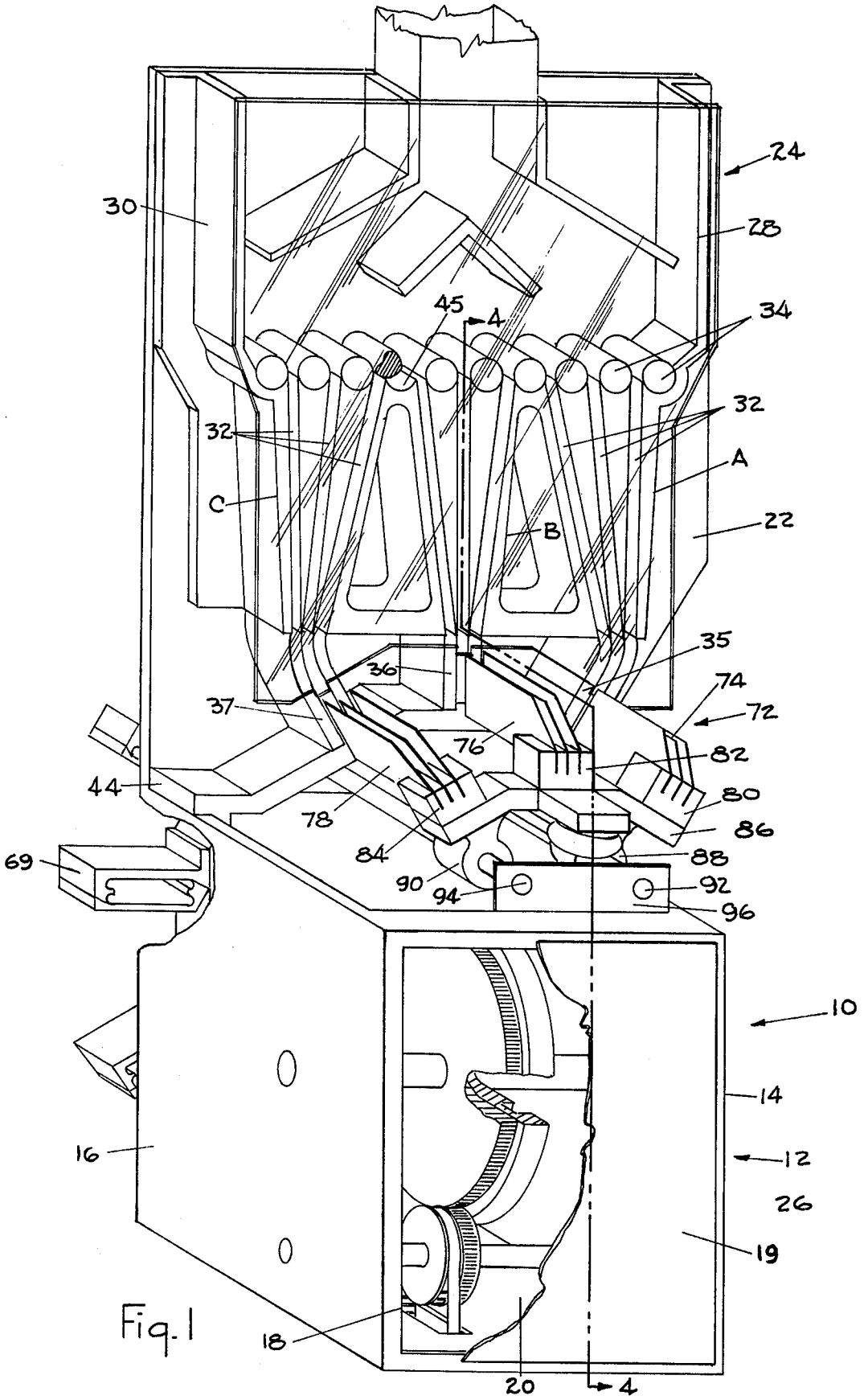
FIG. 1 is a perspective of the supply and transfer mechanism for use on a cigarette packaging machine according to the present invention.

Referring more particularly to the drawings, in FIG. 1, the numeral 10 indicates a supply and transfer mechanism having a frame 12 including a right and left vertical plate 14 and 16, respectively, secured together with a suitable front frame 18 having an access opening 20 which can be covered by an access door 19. This frame assembly has a rear vertical plate 22 secured thereto which is part of a cigarette feed hopper 24. The feed hopper includes the back plate 22 and upper vertical side plate castings 28 and 30 which make up a reservoir portion. The lower portion of the hopper includes a vein section integrally cast with the upper vertical side plates of the reservoir section. The vein section has three feed paths — A, B, and C — each including three feed veins 32. The feed veins are generally vertical and communicate at the upper end with the hopper. The upper ends of the feed veins are generally spaced equally apart and at least two agitator assemblies 34 are positioned next to each feed vein.

Figure 2:
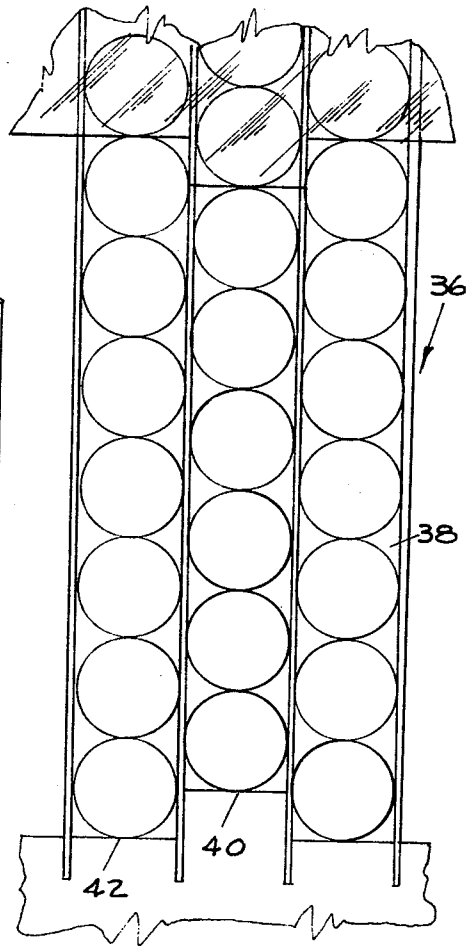
FIG. 2 is a detailed view of a counter section of the present invention illustrating the number of cigarettes in each compartment thereof.

In this preferred embodiment, there are a total of nine feed veins, three for each feed path and a total of ten agitator assemblies 34. Therefore, the two outer agitators are used only with the two outer feed veins, while the remaining agitators are associated with two feed veins. The operation of the agitator drive assembly will be explained hereinafter. The three veins in each feed path converge with one another and form counter sections — 35, 36 and 37. The counter sections are segregated into three compartments — 38, 40 and 42 — as can be seen in FIG. 2. Each of the feed veins in each feed path feeds one compartment in a counter section. The two outside compartments 38 and 42 receive seven cigarettes while the center compartment 40 receives only six cigarettes. The counter sections are secured to a bridge 44 on frame 12 which is located in front of the compression pocket drum at the eleven, twelve and one o'clock positions. The center counter section 36 associated with feed path B is positioned at the twelve o'clock position so that its compartments are generally perpendicular to the horizontal. The two outer counter sections 35 and 37 are positioned at the one and eleven o'clock positions so that their compartments are generally at a slight angle from the perpendicular.

Figure 3:
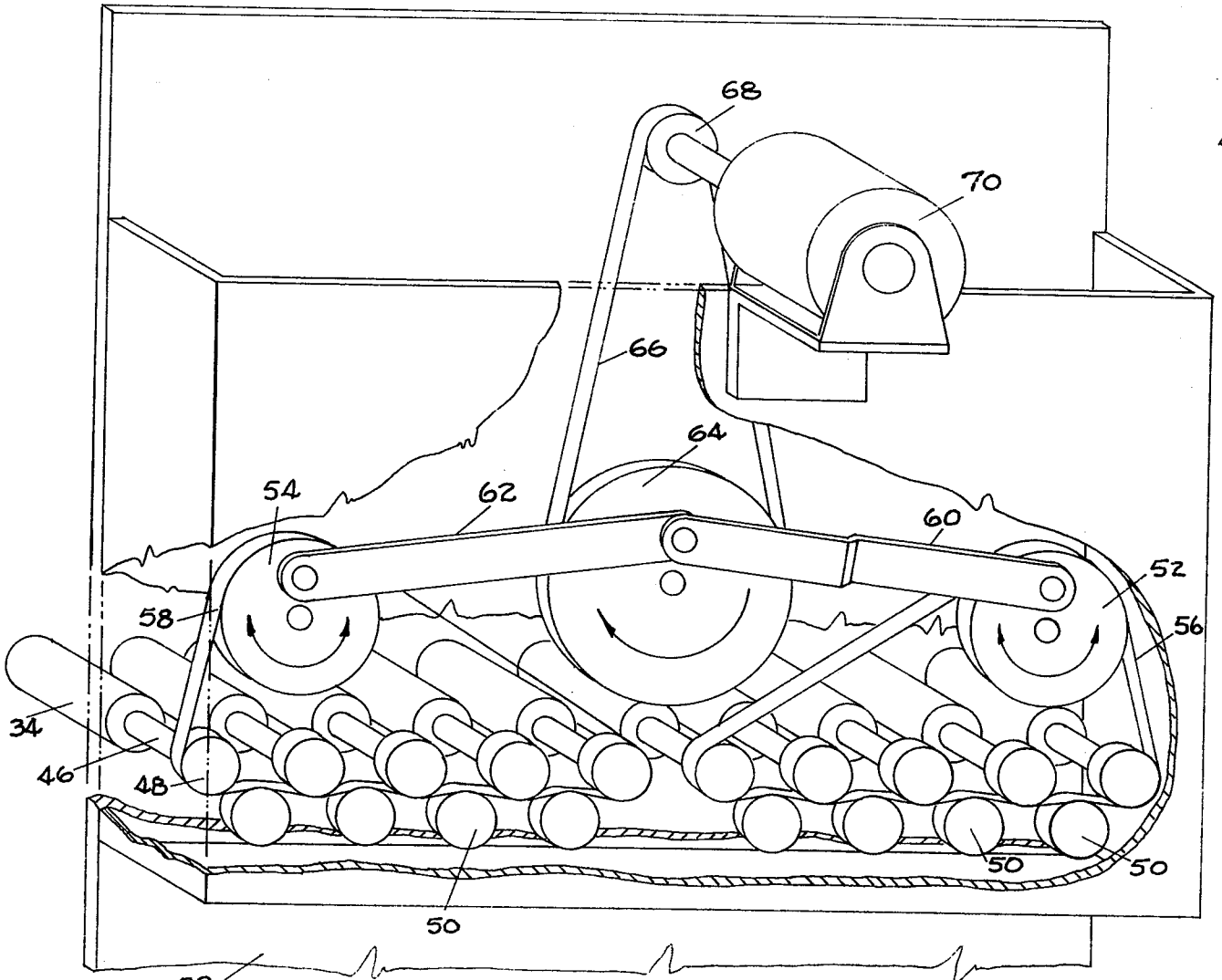
FIG. 3 is an enlarged rear detail of the agitator mechanism on the hopper feed system according to the present invention with the hopper back plate partially removed for clarity.

The agitators 34 are cradled in grooves 45 positioned on the divider portions of the hopper which separate the feed veins. Shafts 46 of the agitators 34 (see FIG. 3) extend through the rear vertical frame member 22. Each of the shafts has a pulley sprocket 48 secured to the rear end. As can be seen in FIG. 3, there are ten agitators. Located below the agitator pulleys and journaled within a back plate are idle rollers 50 which are positioned between each two agitator pulley sprockets. For example, there are five agitator pulley sprockets, shown in FIG. 3, on the left and five on the right, thus, there would be four idle rollers positioned on each side, one being located between two of the agitator pulley sprockets. Suitably journaled above the agitator pulleys and aligned therewith are two oscillating pulleys 52 and 54. The oscillating sprockets 52 and 54 are encircled by timing belts, 56 and 58, respectively, which also encircle the five agitator pulleys to their respective side. The belts are threaded between the agitator pulleys and the idle rollers. Therefore, the timing belts are held between the agitator pulleys 48 and the idle rollers 50, as can be seen in FIG. 3. Connecting rods 60 and 62 which are pivotedly secured to the pulleys 52 and 54 are offset from the center of the sprockets above the center line. The connecting rods 60 and 62 extend generally horizontally and are pivotedly secured to a central pulley 64 which is journaled in the back plate. The point of connection of the connecting rods to the sprocket 64 is offset from its center; therefore, upon rotation of the pulley 64, the pulleys 52 and 54 oscillate, as illustrated in FIG. 3 which causes the agitator pulleys and, thus, the agitators to oscillate. Surrounding pulley 64 is a timing belt 66 which also surrounds the pulley 68 on electric motor 70 which is mounted on a bracket above the agitators. The electric motor can be a single-speed, two-speed or variable speed motor, depending on the desired flexibility of the agitator system.

Figure 4:
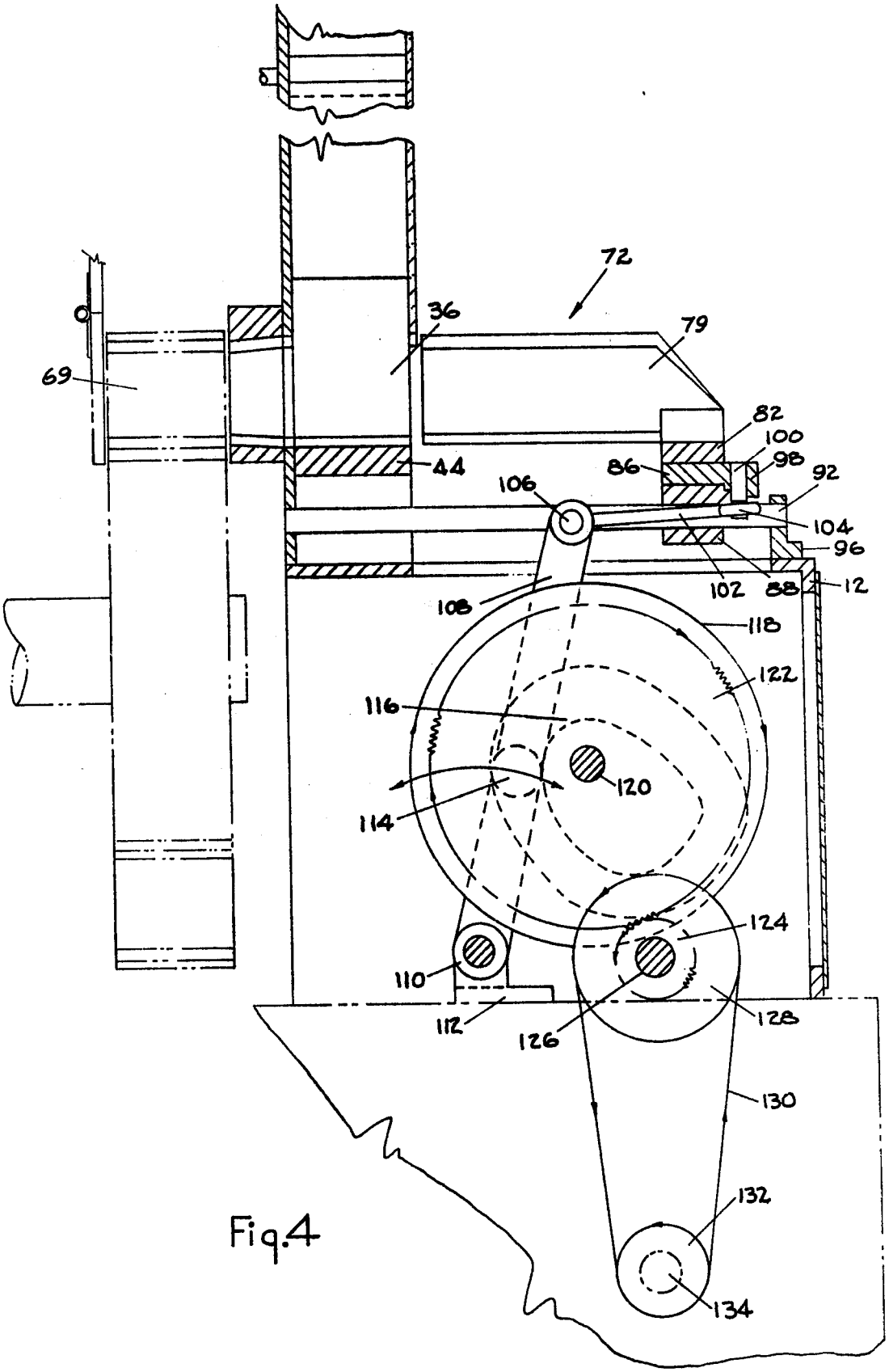
FIG. 4 is a cross-section view taken along line 4–4 of FIG. 1.

When the cigarettes have been delivered to the counter sections 35, 36 and 37 by the operation of the agitator system, the compression pocket drum or turret is indexed by appropriate means so that a compression pocket 69 is located behind each counter section at eleven, twelve and one o'clock. In the original AMF packer, the counter section is located at the nine o'clock position and, at that point, a cam is utilized to open the compression pocket slightly so that the cigarettes can be inserted easily. In this improved transfer device, the cam (not shown) is modified to open the compression pocket at the eleven, twelve and one o'clock positions when the drum indexes. As the drum is indexed, a plunger assembly 72 will be reciprocated, pushing the cigarettes in the counter sections 35, 36 and 37 into the compression pockets. The plunger assembly is made up of a right, center and left plunger 74, 76 and 78, respectively, corresponding to the counter sections. Each of the three plungers has three rectangular pusher elements which are parallel to one another. The pusher elements are so spaced that, when the plunger assembly is reciprocated, each of the pusher elements is inserted through a compartment of one of the counter sections. The three pusher elements of each plunger are secured to mounting blocks 80, 82 and 84, respectively, which are, in turn, secured to a bridge casting 86. The bridge casting is formed similar to the bridge 44 upon which the counter sections are secured. It has a center horizontal portion and two angled wing portions, as can be seen in FIG. 1. Formed with the bracket 86 are cylindrical portions 88 and 90 which are attached to the wing sections. The cylindrical portions have a bore extending through their center and a bushing compressed therein. The cylindrical portions are carried on guide rods 92 and 94 which extend through the bores and which maintain the alignment of the plunger assembly as it is reciprocated. The guide rods are secured to an angle 96 positioned near the front of the frame 12. Extending downwardly from the bracket 86 at the center of the horizontal portion is a lug 98 which has a post 100 fixedly secured therein (see FIG. 4). The post is connected to a connecting rod 102 by a ball joint 104.

The connecting rod extends rearward under the plunger assembly and is pivotedly secured by a ball joint 106 to a plunger drive lever 108. The other end of the plunger drive lever 108 is pivotedly attached at 110 to a bracket 112 secured on the frame 12. A cam follower 114 is carried on the plunger drive lever and engages a pasitime movement cam such as a cam track 116 in the face of a rotating cam 118. The rotating cam is fixedly secured to a shaft 120 which is suitably journaled in the vertical end plates 14 and 16 of the frame 12. The cam track 116 is so arranged on the cam face that the lever arm is oscillated over a range sufficient enough to cause the plunger assembly 72 to reciprocate. Secured to the cam 118 is a spur gear 122 which is, in turn, meshed with another spur gear 124 which is fixedly secured to a second shaft 126 which is suitably journaled between the upright members 14 and 16 of frame 12. Also carried on the shaft 126 is a timing pulley 128 which is surrounded by a timing belt 130 which, in turn, surrounds a power take off pulley 132 secured to an existing shaft 134. It should be understood that the power for the supply and transfer mechanism can be taken from another source if so desired.

Operation

The supply and transfer mechanism illustrated and described above operates in the following manner. Cigarettes are supplied to the hopper reservoir portion 24 and migrated downwardly through the baffles which distribute them over the feed paths — A, B and C. The agitators oscillate, thus, causing cigarettes to flow through the veins 32 in each of the feed paths. The cigarettes continue down the veins due to the oscillation of the agitators and gravity and move into the counter sections 35, 36 and 37. Twenty cigarettes are distributed in the counter sections with seven being in each compartment 38 and 42 and six being in compartment 40. When the compression pocket drum has indexed with three empty compression pockets at the upper three positions of the drum behind the counter sections, the plunger assembly 72 is reciprocated to engage the cigarettes in the counter section and push them into the compression pockets. Then the plunger assembly is retracted from the counter sections to its ready position. After the plunger assembly is retracted from the counter sections and while the compression pocket drum rotates to index the next three empty compression pockets behind the counter sections, the counter sections are filled with cigarettes. It can easily be seen that more time is available for filling the counter sections because the drum has to index three spaces.

This can be illustrated in the following table.

| | Insertion Time | Insertion Time Dwell | Retraction Time | Retraction Time Dwell |
|---|---|---|---|---|
| Single Plunger | 140° | None | 80° | 140° |
| Triple Plunger | 255° | 30° | 255° | 540° |

The time is referenced in degrees to one index cycle of the compression pocket drum where 360° = one indexing cycle.

As can be seen from the above figures, the ratio of the retracted dwell duration times of the single and triple plungers is 540°/140°. Therefore, the triple plunger has approximately 3.86 more cycle time available to fill the counter section than does the single plunger. Another helpful comparison might be in terms of time at various p/m — packs per minute. The cycle time for one pack at a rate of 200 packs per minute would be 1/200 of a minute. To determine the retracted dwell time in minutes for a single plunger device at 200 p/m would be $1/200 \times 140°/360° = 0.0019$ min. or 12/100 sec. For the triple plunger device, the retracted dwell time for a 200 p/m rate would be $1/200 \times 540°/360° = 0.0075$ min. or 45/100 sec. As can be easily seen by this formula, as the packs per minute creases, the retracted dwell time for each of the single and triple plunger units would be decreased. It should also be noted from the table above that the insertion time of the triple plunger is 1.8 times (255°/140°) as long as the single plunger and the retraction time is 3.2 times (255°/80°) as long as the single plunger. There is no insertion dwell time for a single plunger, and the triple plunger has a 30° insertion dwell time. This 30° insertion dwell time prevents the rebound problems mentioned above. Furthermore, the longer insertion time reduces the impact of the plungers on the cigarettes, thereby reducing the loose end problem as well as the number of wrinkled or buckled cigarettes. Overall, the triple headed plunger mechanism treats the cigarettes more gently as they are transferred so that the problems encountered with the single plunger transfer mechanism as the speed of the packer increases are markedly reduced.

It can be seen from the above description and drawings that this improved supply and transfer mechanism for use on a cigarette packing machine will significantly reduce light packs while the packer is operating at high speed because of the increased amount of retracted dwell time allowed for filling the counter section. It also provides a mechanism which handles the cigarettes more gently due to the increased amount of time for insertion and retraction of the plungers and reduces the speed at which the plungers operate, thus, reducing the impact on the cigarettes. The present supply and transfer device also prevents the deformation and crimping of cigarettes because of the increased insertion time and it also prevents the rebound problem, thus, eliminating the cut-off cigarette problem.

The described embodiment can be modified in numerous ways, as will be apparent from the foregoing. For example, any number of plungers can be used as long as generally vertical feed veins and counter sections can be maintained. Other minor variations in the structure of the hopper assembly and variations in the method of driving the plunger assembly can also be made. These and other variations and changes can be made in the invention as above described and illustrated without departing from the true spirit and scope thereof as defined in the following claims.

What is claimed is:

1. An improved supply and transfer apparatus for a cigarette packing machine which transfers groups of twenty cigarettes into compression pockets carried on an intermittent motion conveyor of said cigarette packing machine, said compression pockets being indexed adjacent said supply and transfer mechanism, said apparatus comprising:

(a) at least three transfer chambers, each receiving a group of cigarettes, each of said transfer chambers being in registration with one of three adjacent compression pockets on said conveyor when said conveyor is indexed;

(b) hopper means connected to said transfer chamber for receiving a supply of cigarettes and distributing said cigarettes to said transfer chambers;

(c) at least three plungers being operated simultaneously to engage the groups of cigarettes in said transfer chambers and insert the cigarettes into the three adjacent compression pockets in registration with said transfer chambers when said conveyor is indexed; and (d) means for operating said plungers only after at least each third successive index of said conveyor.

2. The apparatus of claim 1, wherein said hopper means include:

(a) a reservoir section for receiving a supply of cigarettes;

(b) vein sections having at least three feed paths, each containing three feed veins for directing said cigarettes from said reservoir section to said transfer chambers; and (c) means for agitating said cigarettes in said reservoir sections to prevent clogging of said feed paths so that the cigarettes will move into said feed veins.

3. The apparatus of claim 2, wherein said transfer chambers have three compartments, each compartment communicating with a feed vein, said transfer chambers being positioned so that the compartments are generally in a vertical position, whereby gravity will move the cigarettes into the compartments from the veins.

4. The apparatus of claim 3, wherein each of said plungers includes three pusher elements, each pusher element being inserted into a single compartment of said transfer chambers to insert the cigarettes in said compartment into said compression pocket upon operation of said plunger.

5. The apparatus of claim 1, wherein said transfer chambers have three compartments adjacent to one another for receiving cigarettes from said hopper means, said compartments being positioned generally vertically, whereby gravity will move the cigarettes into the compartments from said hopper means.

6. The apparatus of claim 5, wherein each of said plunger includes three pusher elements, each pusher element being inserted into a single compartment of said transfer chamber to insert the cigarettes in said compartments into said compression pockets upon operation of said plunger.

7. The apparatus of claim 1 wherein said conveyor is a rotatable turret and wherein said transfer chambers are positioned adjacent to turret at the eleven, twelve and one o'clock positions.

8. The apparatus of claim 7, wherein said plungers are located adjacent the eleven, twelve and one o'clock positions and are adapted to insert the cigarettes in the transfer chambers into the compression pockets on the rotary turret.

9. The apparatus of claim 1, wherein said means for operating said plungers includes:

(a) bracket means for carrying said plungers;

(b) a connecting rod having a first end pivotedly secured to said bracket means;

(c) a lever having one end pivotedly secured to said packing machine and the other end pivotedly secured to the other end of said connecting rods;

(d) a cam follower carried on said lever;

(e) a positive movement cam engaged by said cam follower so that said plungers can be inserted and removed from said transfer chambers only after at least each third successive index of said conveyor; and (f) means connected to said packing machine drive mechanism and synchronized with said conveyor movement for driving said positive movement cam.

* * * * *